US006758619B1

(12) United States Patent
Yeh

(10) Patent No.: US 6,758,619 B1
(45) Date of Patent: Jul. 6, 2004

(54) SPINNING LIQUID DELIVERY CONTAINER

(76) Inventor: Chiung-Miao Yeh, 235 Chung-Ho Box 8-24, Taipei (TW)

( * ) Notice: Subject to any disclaimer, the term of this patent is extended or adjusted under 35 U.S.C. 154(b) by 0 days.

(21) Appl. No.: 10/376,391

(22) Filed: Mar. 3, 2003

(51) Int. Cl.[7] ..... B43K 5/06
(52) U.S. Cl. ..... 401/174; 401/171; 401/180
(58) Field of Search ..... 401/174, 172, 401/171, 176, 182, 180, 150

(56) References Cited

U.S. PATENT DOCUMENTS

| | | | | | |
|---|---|---|---|---|---|
| 873,769 | A | * | 12/1907 | Morris | 401/174 |
| 1,903,022 | A | * | 3/1933 | Bassett | 401/174 |
| 2,108,911 | A | * | 2/1938 | Wetzel | 401/40 |
| 2,272,641 | A | * | 2/1942 | Mureau | 401/288 |
| 2,287,321 | A | * | 6/1942 | Mureau | 401/174 |
| 2,309,861 | A | * | 2/1943 | Mureau | 401/174 |
| 2,457,217 | A | * | 12/1948 | Ernst | 401/34 |
| 3,134,362 | A | * | 5/1964 | Green | 401/135 |
| 4,530,369 | A | * | 7/1985 | Adams | 132/311 |
| 6,213,662 | B1 | * | 4/2001 | Aljanedi | 401/175 |
| 6,474,891 | B1 | * | 11/2002 | Liu | 401/174 |

* cited by examiner

*Primary Examiner*—Gregory L. Huson
*Assistant Examiner*—Huyen Le

(57) ABSTRACT

A spinning liquid delivery container comprises a spinning device. The spinning device is installed at a rear end of a liquid storage cylinder and is formed by a rod body and a cap. The rod body is axially screwed into the cap. A part of the rod body extends to the cap so that the cap is rotatable freely. The rod body has a rod head, the rod head is adhered to an inner wall of the liquid storage cylinder. The spinning device is positioned at a rear end of the liquid storage cylinder. When the cap pushes the rod body to move forwards, the rod head will move slowly to press the liquid surface of the liquid storage cylinder. As a result, the pressure of the liquid in the liquid storage cylinder increases; thus, liquid can be drained out.

7 Claims, 5 Drawing Sheets

SPINNING LIQUID DELIVERY CONTAINER

FIELD OF THE INVENTION

The present invention relates to container, and particularly to a spinning liquid delivery container, wherein a spinning device is added to a rear end of a liquid storage cylinder. When the user rotates the spinning device to apply a pressure to the liquid in the liquid storage cylinder, the liquid can drain out steady.

BACKGROUND OF THE INVENTION

The prior art coating, erasing-or writing tools (such as correction liquid pen, writing pens, etc.) has a liquid delivery container. Referring to FIG. 1, in these containers, a soft liquid storage cylinder is filled with liquid. The user gives a pressure to the liquid storage cylinder to give a pressure to the liquid so that the liquid flows out from an outlet at a front end of the container. The prior art structure is simple. In use, the user must give a pressure to deform the liquid storage cylinder. The flow cannot be well controlled.

With reference to FIG. 2, an improvement of the prior art liquid storage cylinder is shown. In this prior art, a rear end of the liquid storage cylinder is installed with a plug push device so that the pressure in a gas chamber increases to drive the plug in the liquid storage cylinder to move forwards so as to apply a pressure to the liquid in the liquid storage cylinder. Thereby, liquid in the liquid storage cylinder drains out from a front end of the liquid storage cylinder. This prior art has the following disadvantages. Many components are required to form the press type liquid container. The volume of the gas chamber is small, pressure applied can not be well controlled so that volume of output liquid is too much or too less. When the liquid in the liquid storage cylinder is less, the user must press many times for driving the liquid out. The flow is uncontrollable so that it is not suitable for devices necessary to fine-control the liquid flow.

SUMMARY OF THE INVENTION

Accordingly, the primary object of the present invention is to provide a spinning liquid delivery container. The container comprises a spinning device. The spinning device is installed at a rear end of the liquid storage cylinder and is formed by a rod body and a cap. The rod body is axially screwed into the cap; a part of the rod body with a predetermined length is extended to the cap so that the cap is at a rear end of the liquid storage cylinder and is rotatable freely. The rod body has a rod head. The rod head is adhered to an inner wall of the liquid storage cylinder so as to retain a predetermined damping stress. Thereby, the spinning device can be positioned at a rear end of the liquid storage cylinder. Then the cap will push the rod body to move forwards so that the rod head will move slowly to press the liquid surface of the liquid storage cylinder. As a result, the pressure of the liquid in the liquid storage cylinder increases. Thus, liquid can be drained out from the outlet in the front end of the liquid storage cylinder.

The various objects and advantages of the present invention will be more readily understood from the following detailed description when read in conjunction with the appended drawing.

DETAILED DESCRIPTION OF THE PREFERRED EMBODIMENTS

Figure 1:
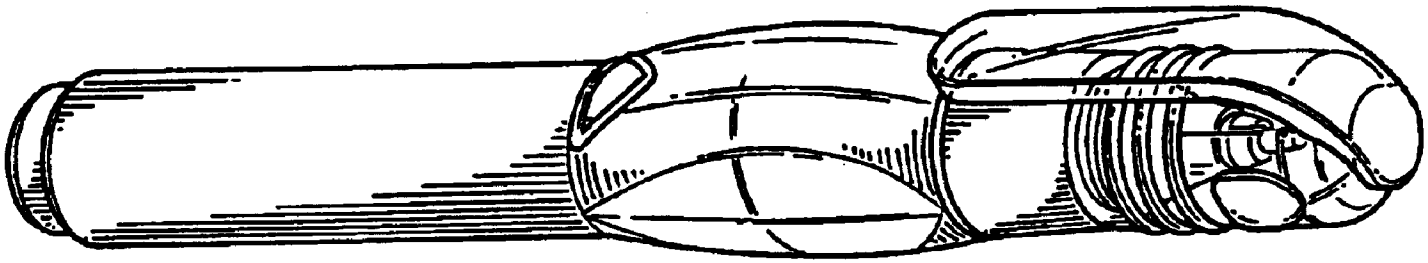
FIG. 1 PRIOR ART
FIG. 1 is a perspective view of a prior art liquid container.
Figure 2:
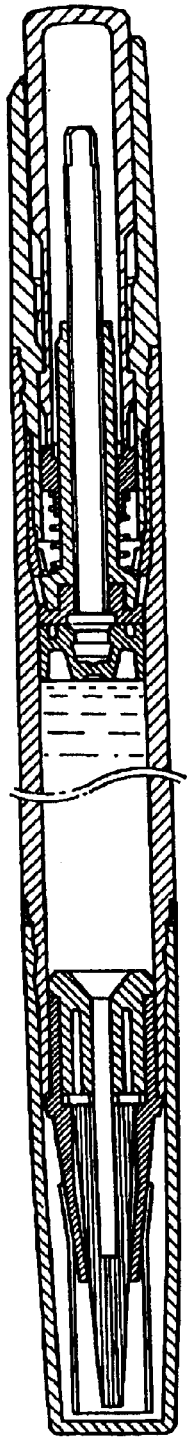
FIG. 2 PRIOR ART
FIG. 2 is a cross section view of another prior art push-type liquid container.
Figure 3:
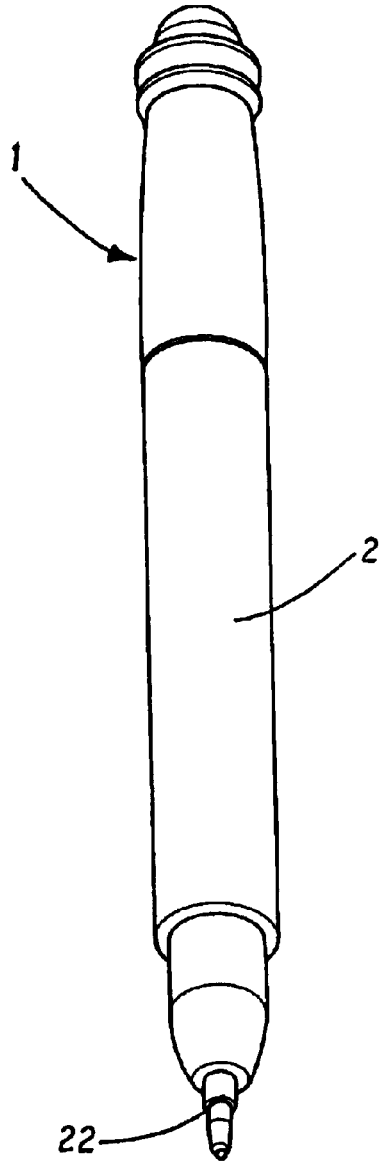
FIG. 3 is an assembled perspective view of the present invention.
Figure 4:
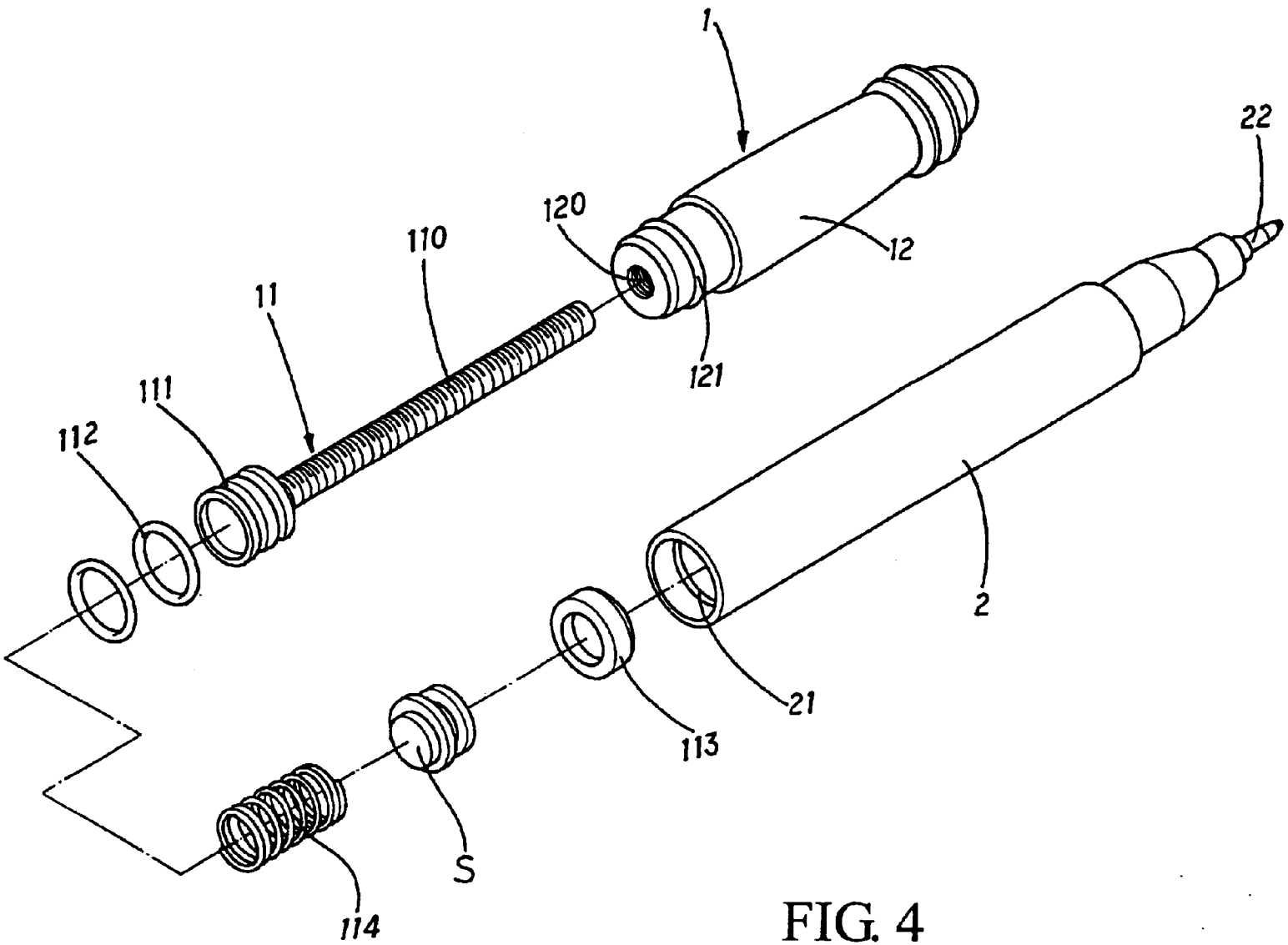
FIG. 4 is an exploded perspective view of the present invention.
Figure 5:
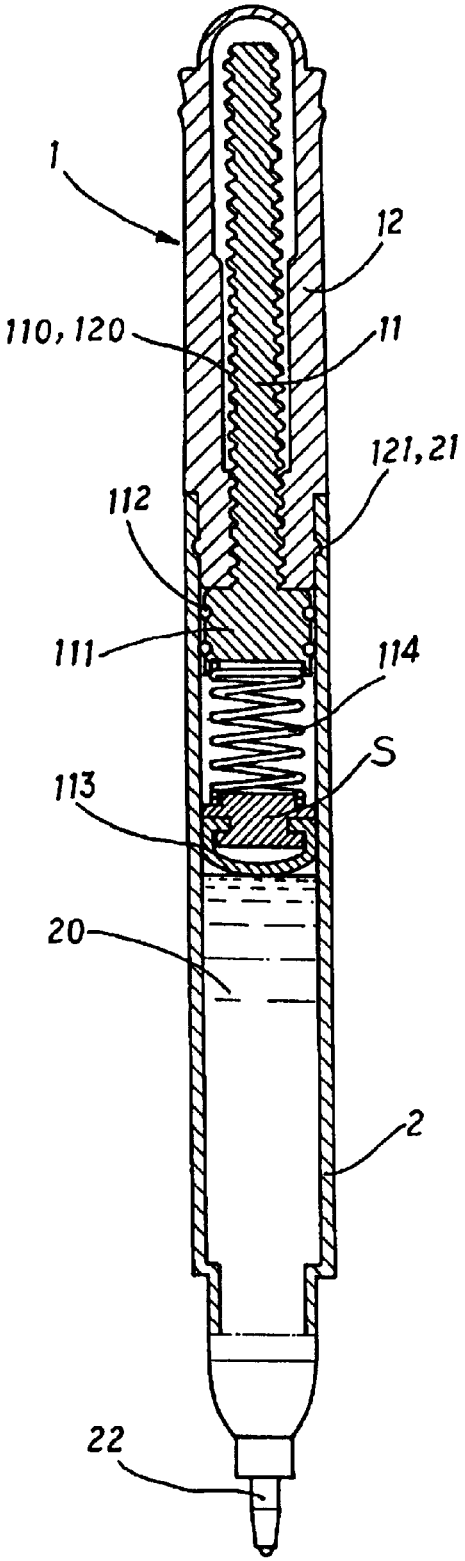
FIG. 5 is an assembled cross section view of the present invention.
Figure 6:
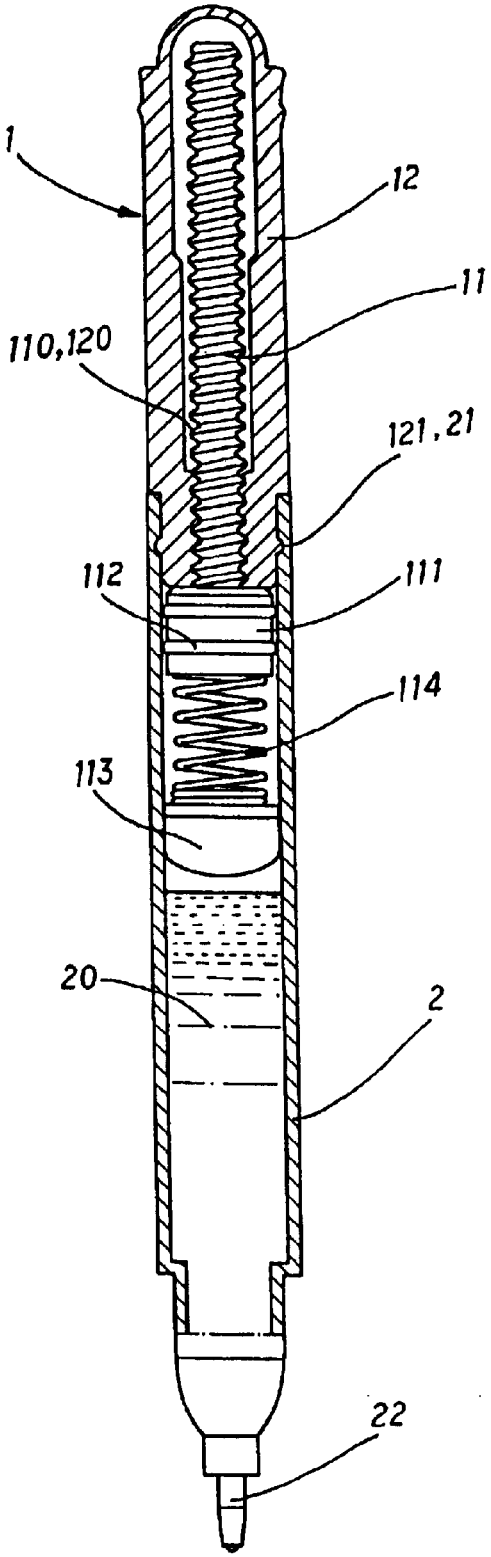
FIG. 6 is a cross section view showing that the present invention is used to descend the level of a liquid storage cylinder and to spin the spinning device.
Figure 7:
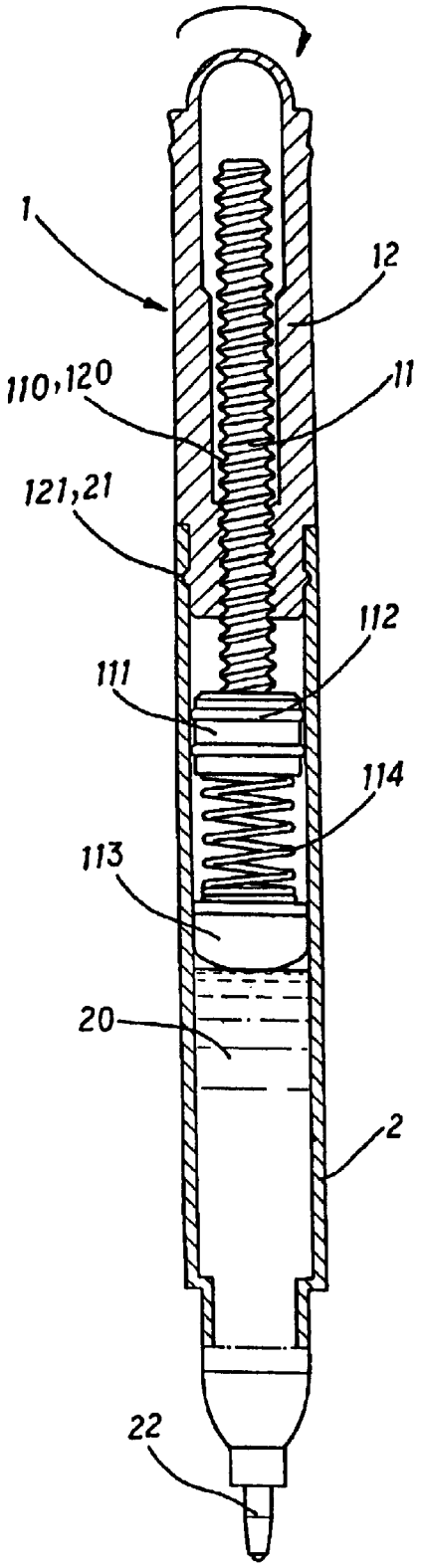
FIG. 7 is a schematic view showing that a cap of the present invention drives a rod body axially and the rod head applies a pressure to the liquid in the liquid storage cylinder according to the present invention.
Figure 8:
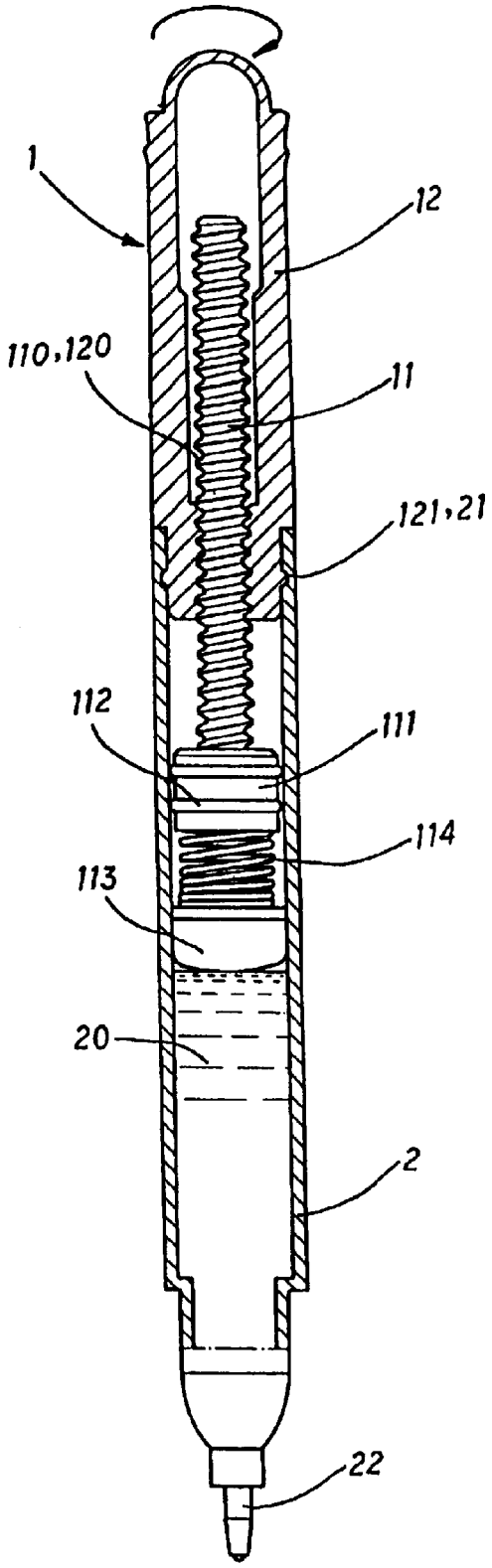
FIG. 8 is a schematic view showing that a cap of the present invention drives a rod body axially

Referring to FIGS. 3 to 5, the spinning liquid delivery container of the present invention is illustrated. The spinning liquid delivery container includes a spinning device 1. The spinning device 1 is installed at a rear end of the liquid storage cylinder 2 and is formed by a rod body 11 and a cap 12. The rod body 11 is a screw rod with male thread 110 and is axially screwed into a threaded hole 120 in the cap 12. A periphery of the rod head 111 of the rod body 11 is mounted with a washer 112. A pad S and a silicone plug 113 are placed at a front end of the rod body 11. A part of the rod body 11 with a predetermined length is extended to the cap 12. In the engaging portion of the cap 12 and the liquid storage cylinder 2, the cap 12 has a rib 121 and the liquid storage cylinder 2 has an annular groove 21 so that the cap 12 is exactly engaged to a rear end of the liquid storage cylinder 2 and is rotatable freely. At the same time, the rod head 111 is adhered to an inner wall of the liquid storage cylinder 2. The washer 112 deforms since it is extruded by the inner wall so as to retain a predetermined damping stress. Thereby, when the cap 12 is rotated, the rod body 11 will not be driven to rotate. By above said structure, the spinning device 1 can be positioned at a rear end of the liquid storage cylinder 2. When the level of the liquid storage cylinder 2 is reduced, as shown in FIG. 6, the cap 12 can be rotated. Then cap 12 will push the rod body 11 to move forwards so that the rod head 111 will move slowly to press the liquid surface of the liquid storage cylinder 2 (referring to FIG. 7). As a result, the pressure of the liquid 20 in the liquid storage cylinder 2 increases (referring to FIG. 8). Thus, liquid 20 can be drained out from the outlet 22 in the front end of the liquid storage cylinder 2.

Referring to FIGS. 3 to 7, it is illustrated that a helical spring 114 is placed between the rod head 111 and the plug 113. The helical spring 114 serves to store energy. When the cap 12 is rotated so as to push the rod 11, the rod head 111 will push the helical spring 114 and the plug 113. The plug 113 applies a pressure upon the liquid 20. When the internal pressure of the liquid 20 in the liquid storage cylinder 2 is larger than the stress of the helical spring 114, the helical spring 114 is compressed and thus deforms (referring to FIG. 8). The liquid 20 flows out of the outlet 21 so that the internal pressure of the liquid storage cylinder 2 is decreased. At the same time, the helical spring 114 will release energy due to the deformation and ejects the plug 113 to give a pressure to the liquid surface until the helical spring 114 restores slowly. Thereby, the liquid is drained out steadily in a long time period and the spinning device 1 can be actuated again. By above feature, the liquid storage cylinder 2 outputs liquid 20 steadily in a long time period. Of course, this steady flow control and transfer can be used in coating or writing tools, especially, used in fine-coating and fine-writing.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A spinning liquid delivery container comprising a spinning device; the spinning device being installed at a rear end of a liquid storage cylinder and being formed by a rod body and a cap; wherein the rod body is axially screwed into the cap; a part of the rod body with a predetermined length is extended to the cap so that the cap is at a rear end of the liquid storage cylinder and is rotatable freely; the rod body has a rod head, the rod head is adhered to an inner wall of the liquid storage cylinder so as to retain a predetermined damping stress;

thereby, the spinning device is positioned at a rear end of the liquid storage cylinder; then cap will push the rod body to move forwards so that the rod head will move slowly to press the liquid surface of the liquid storage cylinder; as a result, the pressure of the liquid in the liquid storage cylinder increases; thus, liquid can be drained out from the outlet in the front end of the liquid storage cylinders;

wherein a helical spring is placed between the rod head and the plug; the helical spring serves to store energy; when the cap is rotated so as to push the rod, the rod head will push the helical spring and the plug; the plug applies a pressure upon the liquid; when the internal pressure of the liquid in the liquid storage cylinder is larger than the stress of the helical spring, the helical spring is compressed and thus deforms; the liquid flows out of the outlet so that the internal pressure of the liquid storage cylinder is decreased; at the same time, the helical spring will release energy due to the deformation and ejects the plug to give a pressure to the liquid surface until the helical spring restores slowly; thereby, the liquid flow is drained out steadily in a long time period and the spinning device is actuated again.

2. The spinning liquid delivery container as claimed in claim 1, wherein the cap has a threaded hole; and the rod body is a screw rod with male thread and is axially screwed into a threaded hole in the cap; when the cap pivotally rotates, since the rod head of the rod body is adhered to an inner wall of the liquid storage cylinder and suffers from a stress applied by the liquid storage cylinder; when the cap rotates, the rod body will not be driven; when the rod body pivotally rotates in the cap, the rod body will move forward due to the threaded engagement between the cap and the rod body so that the rod head moves forwards slowly so as to apply a pressure to liquid in the liquid storage cylinder.

3. The spinning liquid delivery container as claimed in claim 1, wherein a plug is installed at a front end of the rod head; a periphery of the plug is tightly adhered to an inner wall of the liquid storage cylinder; thereby, when the rod head applies a pressure to the liquid in the liquid storage cylinder, the liquid will not drain out.

4. The spinning liquid delivery container as claimed in claim 3, wherein the plug is made of silicone.

5. The spinning liquid delivery container as claimed in claim 1, wherein a periphery of the rod head of the rod body is installed with a washer; when the rod head is placed in the liquid storage cylinder; the washer will be extruded by an inner wall of the liquid storage cylinder so as to deform; thereby the rod head is adhered to the inner wall.

6. The spinning liquid delivery container as claimed in claim 1, wherein a periphery of the rod head is enclosed by a washer.

7. The spinning liquid delivery container as claimed in claim 1, wherein in the engaging portion of the cap and the liquid storage cylinder, the cap has a rib and the liquid storage cylinder has an annular groove so that the cap is exactly engaged to a rear end of the liquid storage cylinder and is rotatable freely.

* * * * *